US006860134B2

(12) United States Patent
Miyauchi et al.

(10) Patent No.: US 6,860,134 B2
(45) Date of Patent: Mar. 1, 2005

(54) IRONING DIES

(75) Inventors: Kunio Miyauchi, Tokyo (JP); Takayuki Aoki, Gunma-ken (JP); Ichiro Takahashi, Saitama (JP)

(73) Assignees: Riken, Saitama (JP); Gunma Prefecture, Gunma-ken (JP); We Plan Company, Tokyo (JP)

( * ) Notice: Subject to any disclaimer, the term of this patent is extended or adjusted under 35 U.S.C. 154(b) by 0 days.

(21) Appl. No.: 09/961,489

(22) Filed: Sep. 25, 2001

(65) Prior Publication Data

US 2002/0083755 A1 Jul. 4, 2002

(30) Foreign Application Priority Data

Dec. 28, 2000 (JP) ..... 2000-401258

(51) Int. Cl.[7] ..... B21D 24/00
(52) U.S. Cl. ..... 72/347; 72/466.8
(58) Field of Search ..... 72/283, 285, 347, 72/348, 349, 710, 466.8, 468, 370.08, 391.2, FOR 101

(56) References Cited

U.S. PATENT DOCUMENTS

| | | | | | |
|---|---|---|---|---|---|
| 2,357,123 | A | * | 8/1944 | Maxwell | 72/393 |
| 3,602,030 | A | * | 8/1971 | Noda et al. | 72/347 |
| 3,715,904 | A | * | 2/1973 | Lesko | 72/468 |
| 3,724,247 | A | * | 4/1973 | Page | 72/347 |
| 3,945,231 | A | * | 3/1976 | Imazu et al. | 72/45 |

FOREIGN PATENT DOCUMENTS

| | | | | |
|---|---|---|---|---|
| JP | 62-234623 | | 10/1987 | |
| JP | 63-248521 | | 10/1988 | |
| JP | 02-046932 | | 2/1990 | |
| JP | 2-295610 | * | 12/1990 | 72/710 |

* cited by examiner

*Primary Examiner*—Lowell A. Larson
(74) *Attorney, Agent, or Firm*—Birch, Stewart, Kolasch & Birch, LLP

(57) ABSTRACT

In press forming including ironing, an elastically deformable material is used for a part of ironing die contacting to the work material under a higher pressure than designed, for taking the formed product out from the die easily in a case that the ironing die and the formed product are very close in size to each other, and thereby improving the efficiency of production.

4 Claims, 6 Drawing Sheets

IRONING DIES

BACKGROUND OF THE INVENTION

1. Field of the Invention

The present invention relates to ironing dies, and in particular to ironing dies suitable for press forming processes including ironing.

2. Description of the Related Art

Press forming including ironing has so far been widely used for producing numerous goods and have been contributing a great deal to all the human beings with respect to the improvement of living conditions and rise of living level.

In such press forming including ironing as mentioned above, many kinds of forming and ironing dies are selected and used to be suitable for each of various products.

The feature of press forming including ironing is characterized by attaching an ironing die firmly to a work material, and thereby exerting a very strong force on a work material in forming, and deforming the work plastically to produce the products of required geometry.

It is therefore difficult sometimes to take the formed product from the ironing die because the die and the product are very close to each other in size, and thereby lower the efficiency of forming.

In particular, the work is given a required force to deform plastically during forming, and thereafter deforms elastically backward from the direction of given deformation during unloading. The elastic return of deformation is called "springback". When the formed product becomes larger by springback, it is harder to remove the product from the die cavity. When the formed product becomes smaller, it is harder to remove the product from the punch.

As for ironing dies in press forming including ironing, it is well known that the part of the ironing dies strongly contacting to the work material is subjected to severe abrasion.

As very anti-abrasive materials are more often used for the part of ironing dies strongly contacting to the work materials, so there is no big choice in the selection of die material for ironing dies.

Besides, there is another difficulty to raise the forming limit because the rupture of lubricant film between the ironing die and the work material takes place easily in case of using conventional ironing dies.

OBJECTS AND SUMMARY OF THE INVENTION

The present invention has been developed considering the above-described problems, and aims at easier removal of the formed product from the ironing dies and higher efficiency of production when the ironing die and the formed product are very close to each other in size.

Further, another object of the present invention is to provide such ironing dies as can widen the extent of material selection for the part of the dies contacting strongly to the work.

Furthermore, the present invention aims at the development of ironing dies for effectively preventing the lubricant film from rupturing and thereby improving the forming limit.

For achieving the above-described objects, at least a part of dies according to the present invention consists of an elastic material or elastic structure.

As for the ironing dies more concretely, for example, the punch or die or a part thereof is made of elastic materials or elastic structures.

The above-described ironing die is elastically deformed by the given force during forming, but the elastically deformed die returns back to its initial geometry (that is, springback) after the forming is finished and unloading takes place. The above-described object is achieved by designing the ironing die so that the required size increase or decrease may occur in relation with the removing condition of the formed parts from the punch or die.

The position of biggest abrasion in the ironing die corresponds to the position of severest deformation. If the elastic structure is used for the position of severest deformation, the severity of deformation is lowered, and the rise of forming limit and the reduction of die abrasion may be expected.

Besides, as long as the above-described elastic structure has no low elastic modulus, the die must be designed to have a hollow space or cavity in its inside. Consequently the die weight is reduced to result in the effective reduction of resources and a considerable merit in the field of production.

If the ironing die is vibrated by some means during forming, the lubricant film may more be protected from rupture and the forming limit may be improved.

The present invention consists of such a material as is possible to elastically deform at the position where the contact pressure between the work and the die is larger than expected in the press forming including ironing.

The ironing dies for press forming including ironing, according to the present invention, consist of multi-stepped ironing dies which are provided with a series of the above-described ironing dies and have at least a part of elastic dies in the above-described ironing dies.

Thus, according to the present invention, it is easier to take the product from the die even if the product is quite the same in size with the die, and thereby the efficiency of production can be improved.

Further, according to the present invention, no special abrasive material is essential for the part contacting strongly to the work, and thereby the wider selection of material is possible for the ironing die.

The present invention is equipped with one or more of the above-described ironing dies for the press forming including ironing and some subsidiary means for vibrating one or more of the above-described ironing dies or all of them during forming.

Such a vibrating means as can give vibration to one or more of the ironing dies or all of them makes possible to prevent the rupture of lubricant film between the work and the die, and thereby can improve the forming limit.

BRIEF DESCRIPTION OF THE DRAWINGS

The present invention will become more fully understood from the detailed description given herein below and the accompanying drawings which are given by way of illustration only, and thus not limitative of the present invention, and wherein.

DETAILED DESCRIPTION OF THE PREFERRED EMBODIMENTS

The performance of ironing with the above-described punch and die according to the present invention is explained below with respect to the attached drawings.

The present invention relates to the simultaneous both-sided ironing in press forming wherein it is possible to yield the positive or negative circumferential residual stress (internal stress) in the wall of formed cup-like vessel depending on the object of the product in service. When the negative stress takes place, the cup wall is subjected to the slight elastic shrinkage in the diameter, and thereby it will be difficult to remove the formed product from the head of ironing punch.

For such a case as described above, the material of low elastic modulus and high elastic limit like a hard high polymer is suitable for the head of ironing punch.

Figure 1:
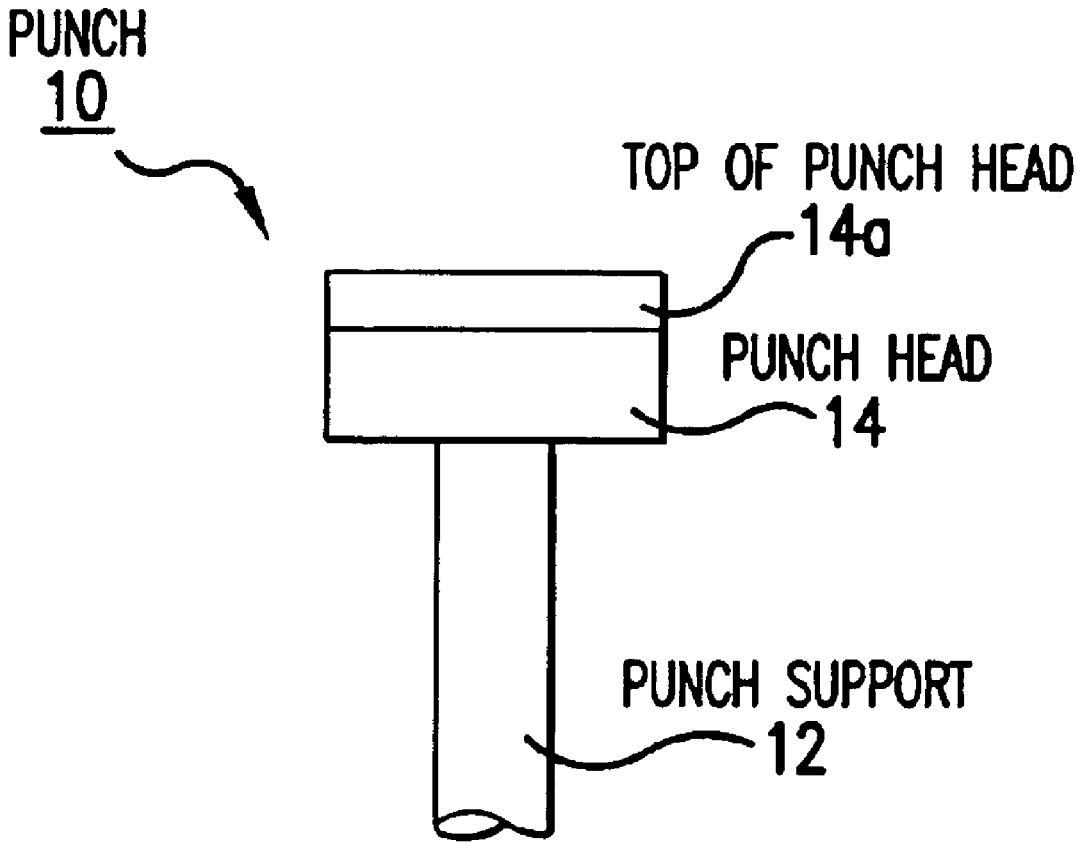
FIG. 1 is an illustrative example of a punch structure for the first performance of ironing according to the present invention.

FIG. 1 is an illustrative example of a punch structure for the first performance of ironing according to the present invention, wherein a punch 10 consists of a punch support 12, and thereon a punch head 14 and the top of the head 14*a*. The elastically deformable head top 14*a* consisting of a hard high polymer expands in diameter under the compression of forming, and shrinks elastically during unloading after the forming, and thereby the formed product can easily be from the head top 14.

Figure 2A:
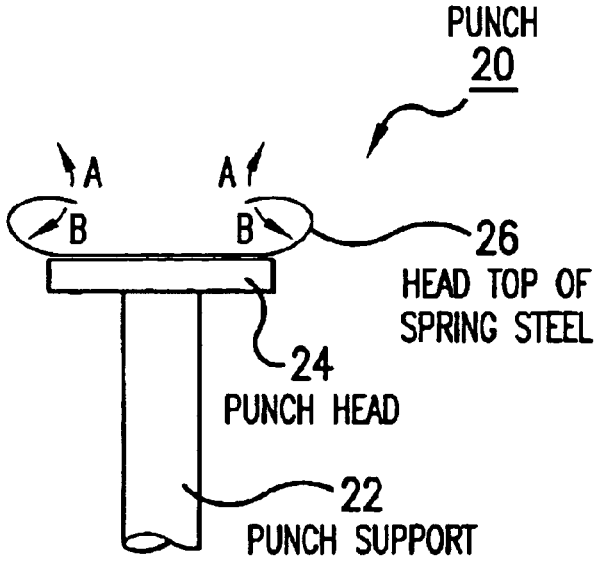
FIG. 2(*a*) is the next example of a punch for the second performance of ironing according to the present invention, and FIG. 2(*b*) is for the third example.
Figure 2B:
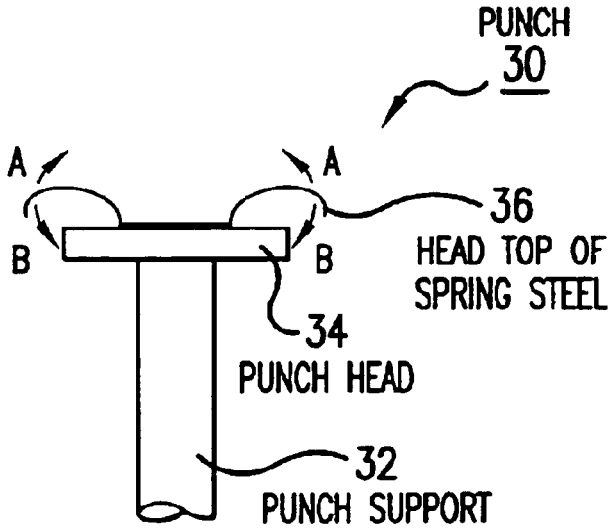

FIG. 2(*a*) is the next example of a punch for the second performance of ironing according to the present invention, and FIG. 2(*b*) is another example for the third performance of ironing according to the present invention.

In the second and third examples of ironing performance according to the present invention, a punch 20 (30) consists of the head top of a punch 26 (36) comprising such a material of high elastic limit like spring steel and a punch head 24 (34) being supported by a punch support 22 (32), wherein an elastically deformable material 26 (36) elastically deforms in the direction of arrow A or B under loading or unloading, respectively, and thereby it will easier to take the product out from the punch.

As for the die structure of deep drawing or ironing, the way of thinking in design is opposite to the case of punch structure. That is, the inner diameter of die is required to be slightly smaller during forming and become larger after forming due to elastic deformation. One example of the die structure required in ironing for the above-described case is shown in FIG. 3.

Figure 3:
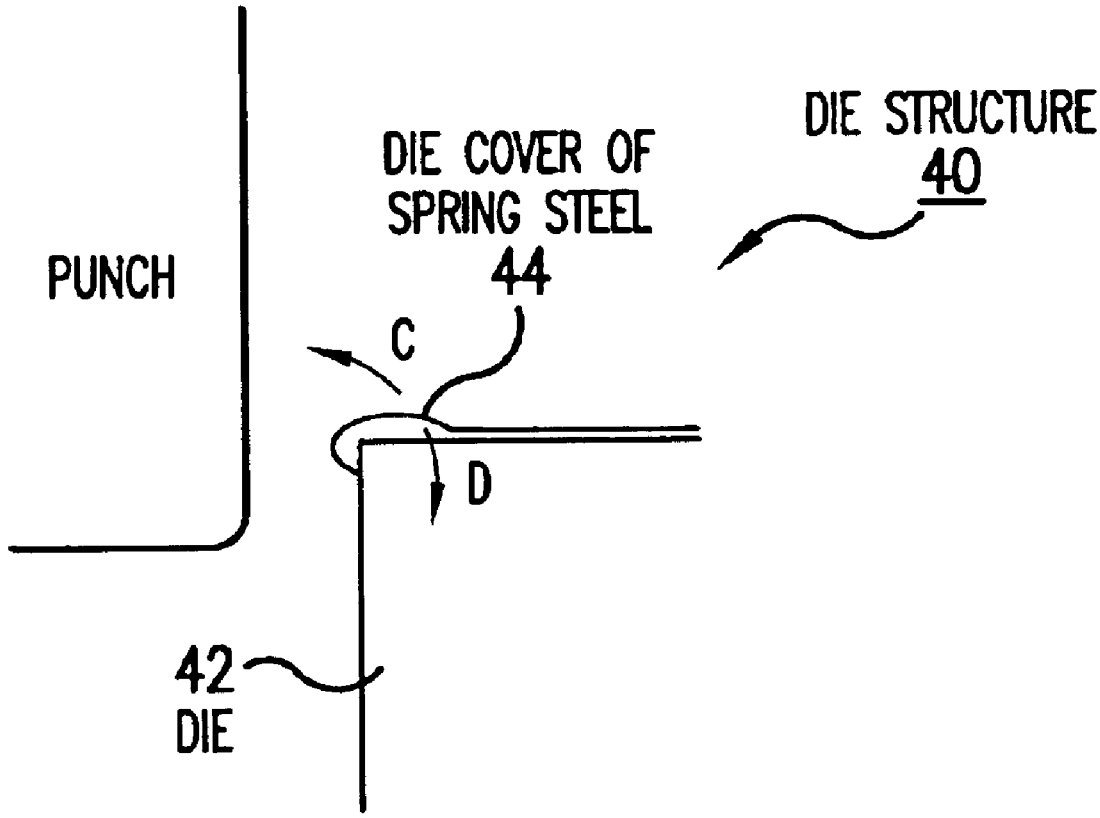
FIG. 3 is the example of a die for the fourth performance of ironing according to the present invention.

As the fourth example of performance in FIG. 3 according to the present invention, the die 40 consists of die support 42 and thereon an elastically deformable material 44 like spring steel which can elastically deform in the direction of arrow C or D.

In the above-described die 40, the elastic die part 44 deforms elastically in the direction of arrow D in forming and returns back in the direction of arrow C after forming and thereby the increased inner diameter of die makes easier the removal of formed products from the die cavity.

Figure 4:
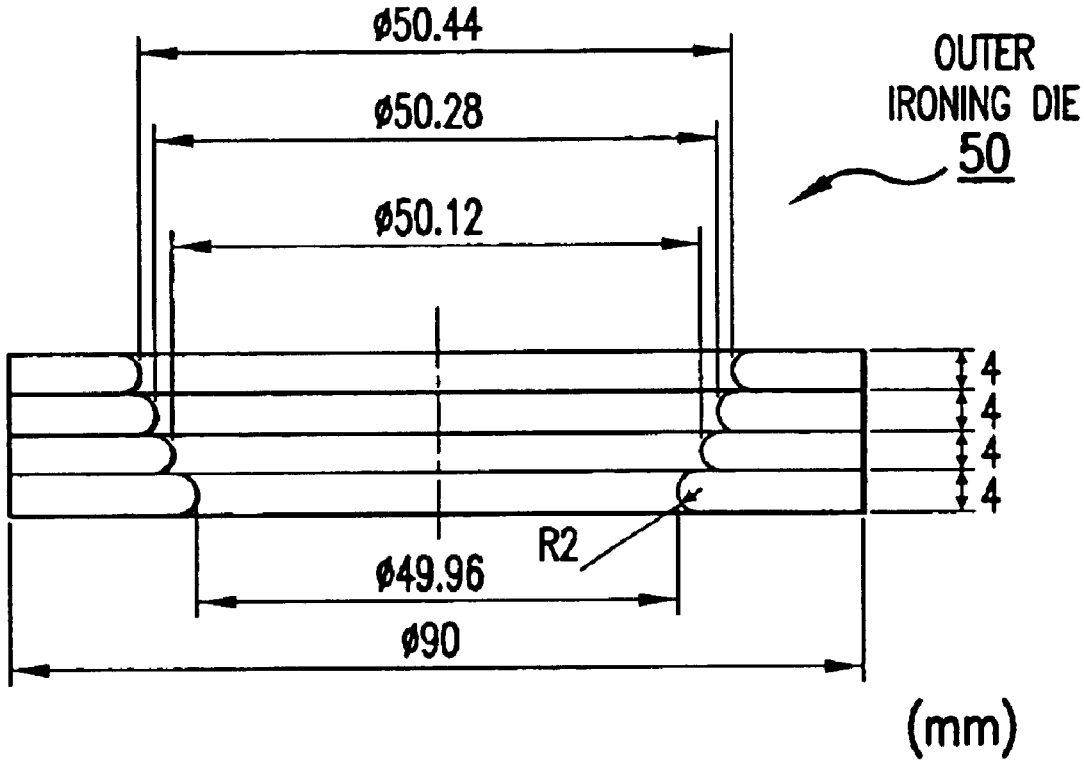
FIG. 4 is the example of multi-stepped dies for the fifth performance of ironing according to the present invention.
Figure 5:
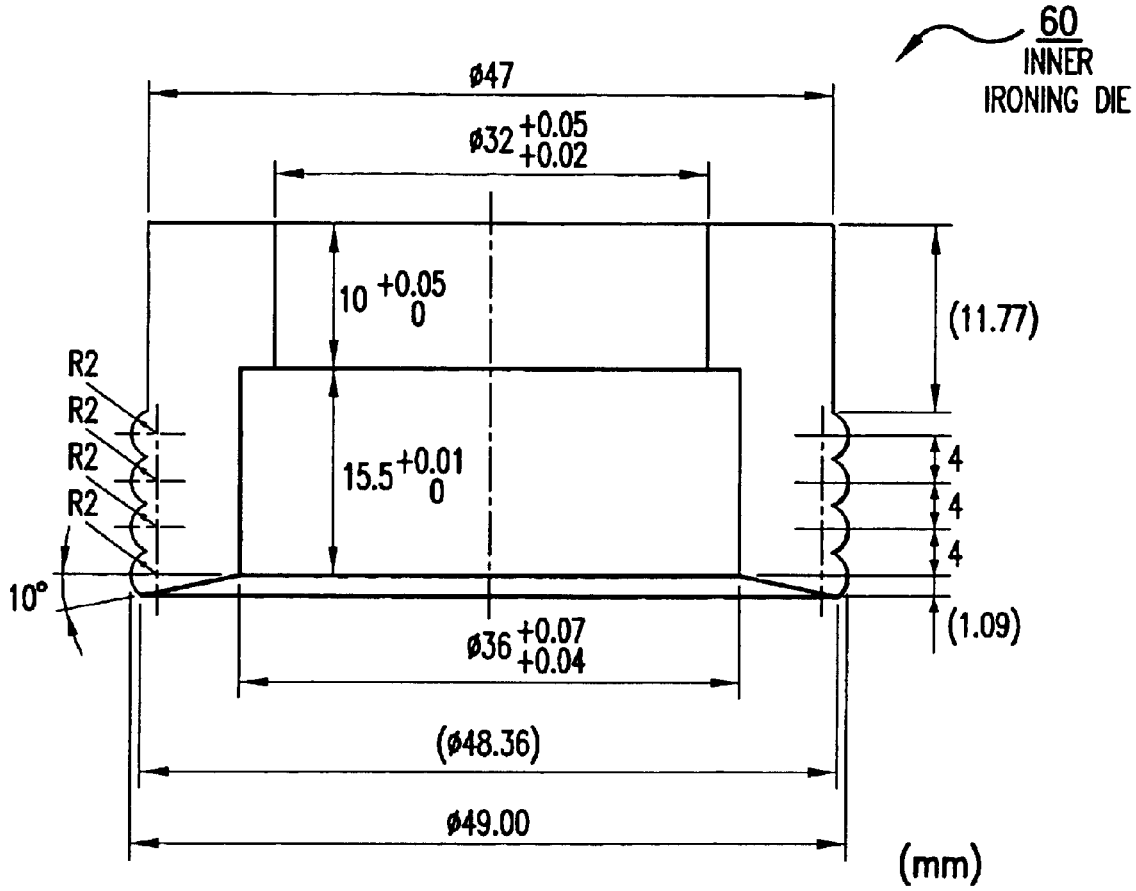
FIG. 5 is another example of multi-stepped dies for the sixth performance of ironing according to the present invention.

In FIG. 4, as the fifth example of performance according to the present invention, is shown a multi-stepped outer ironing die 50, and FIG. 5 shows a multi-stepped inner ironing die for the sixth example of performance according to the present invention.

The ironing outer die 50 and inner die 60 are made of rigid material and consist of multi-stepped dies in series. This type of multi-stepped dies diverges the work of forming to each die and can reduce the severity of forming.

Figure 6:
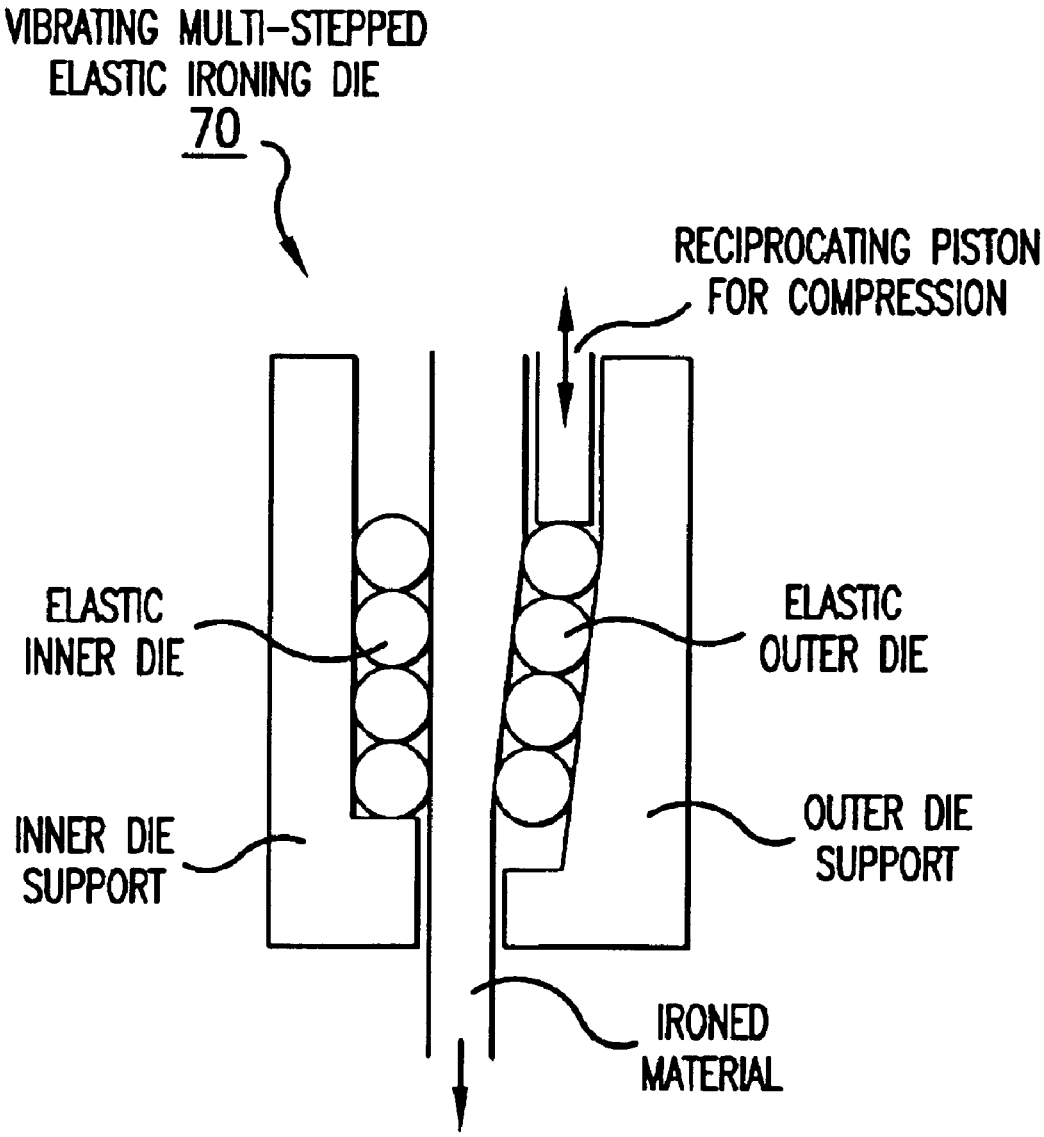
FIG. 6 is the other example of multi-stepped dies for the seventh performance of ironing according to the present invention.

Further, in FIG. 6, as the seventh example of performance according to the present invention, a part or all of multi-stepped inner and/or outer dies consist of elastic material like hard high polymer, and thereby the above-described reduction of forming severity is automatically multiplied.

It is effective to vibrate such elastic inner or outer dies as shown in FIG. 6 with an arbitrary device during forming for improving the forming limit.

FIG. 6 shows one example of the cases for vibrating the multi-stepped elastic outer die with a reciprocating compressing piston. The vibration of elastic inner and/or outer dies produces a very small gap between the multi-stepped ironing dies and the work material at repeated instants and thereby the lubricant oil can more easily get into the loosened gap between the ironing dies and the work material.

For this reason, the lubricant film between the ironing dies and the work material can more exactly be prevented from rupture, and thereby improve the forming limit.

As for the multi-stepped rigid ironing dies, the multi-stepped outer ironing dies 50 and the multi-stepped inner ironing dies 60, the same effect on the prevention of lubricant film from rupture can be expected by vibrating a part or all the ironing dies in the same manner as described above in FIG. 6.

Even in the case of a pair of single dies, the same effect can be expected by giving them such vibration as described above in the case of multi-stepped ironing dies.

As the present invention is composed of the above-described features, the present invention provides such excellent effects as to more easily take the forming product from the ironing die even in a case that the ironing die and the formed product are very close in size to each other.

Further, as the present invention is composed of the above-described features, no strong anti-abrasive material is necessarily required for the position of strong contact between the ironing die and the work material, and thereby it is possible to have a wider selection of die material for severe ironing.

Furthermore, as the present invention is composed of the above-described features, the rupture of lubricant film between the ironing die and the work material can effectively be prevented, and thereby such an excellent effect as can improve the forming limit.

In more detail, according to the present invention, the forming limit is improved, and the ironing die can be lightened and can benefit the saving of resources, and the taking-out of the product and the following operations can be rationalized, and the abrasion of the ironing dies can be reduced.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive.

The scope of the invention is indicated by the appended claims rather than the foregoing description, and all changes that come within the meaning and range of equivalents thereof are intended to be embraced therein.

The entire disclosure of Japanese Patent Application No.2000-401258 filed on Dec. 28, 2000 including specification, claims, drawings and summary are incorporated herein reference in its entirety.

What is claimed is:

1. An ironing die for use in press forming with ironing, said ironing die comprising:

a first part which is not elastically deformable; and a second part in contact with material being formed which is elastically deformable;

said second part being deformed during the press forming and elastically returning after the press forming sufficiently to allow a formed product to be more easily removed.

2. An ironing die according to claim 1, further comprising:

a vibrating device for vibrating said ironing die during ironing.

3. An ironing die arrangement for press forming with ironing, comprising:

a plurality of ironing dies, arranged in series for multi-stepped ironing;

at least one of said plurality of ironing dies having a first part which is not elastically deformable and a second part in contact with material being formed made of an elastically deformable material which deforms during press forming sufficiently to allow a formed product to be more easily removed.

4. An ironing punch for press forming with ironing, comprising:

a first part which is not elastically deformable;

a second part in contact with material being formed which is elastically deformable;

said second part being deformed during press forming and returning elastically after the press forming sufficiently to allow a formed product to be more easily removed.

* * * * *